US008430281B2

(12) United States Patent
Kim et al.

(10) Patent No.: US 8,430,281 B2
(45) Date of Patent: Apr. 30, 2013

(54) HIGH-HEAT-RETENTION LADLE FOR CARRYING MOLTEN ALUMINUM

(75) Inventors: Eok Soo Kim, Ulsan (KR); Young Myung Hong, Ulsan (KR); Kyung Mook Lim, Seoul (KR); Sock Hwan Choi, Ulsan (KR); Jin Young Park, Ulsan (KR)

(73) Assignee: Korea Institute of Industrial Technology, Cheonan-si (KR)

( * ) Notice: Subject to any disclaimer, the term of this patent is extended or adjusted under 35 U.S.C. 154(b) by 385 days.

(21) Appl. No.: 12/788,000

(22) Filed: May 26, 2010

(65) Prior Publication Data

US 2010/0301073 A1 Dec. 2, 2010

(30) Foreign Application Priority Data

May 27, 2009 (KR) ..... 10-2009-0046335

(51) Int. Cl.
*B22D 41/14* (2006.01)

(52) U.S. Cl.
USPC ..... 222/597; 222/590; 222/594; 266/236

(58) Field of Classification Search ..... 266/275, 266/280, 230, 227, 45, 236; 222/590, 591, 222/594, 597, 595
See application file for complete search history.

(56) References Cited

U.S. PATENT DOCUMENTS

| | | | | |
|---|---|---|---|---|
| 2,808,338 | A * | 10/1957 | Bruno et al. | 252/62 |
| 5,318,277 | A * | 6/1994 | Brown et al. | 266/275 |
| 2007/0215483 | A1 * | 9/2007 | Johansen et al. | 205/358 |
| 2008/0277617 | A1 * | 11/2008 | Abdul-Kader et al. | 252/62 |

FOREIGN PATENT DOCUMENTS

| | | | |
|---|---|---|---|
| CN | 101249557 | * | 8/2008 |
| CN | 101249557 A | | 8/2008 |
| JP | 2003112256 | * | 10/2001 |

* cited by examiner

*Primary Examiner* — Scott Kastler
*Assistant Examiner* — Michael Aboagye
(74) *Attorney, Agent, or Firm* — Christie, Parker & Hale, LLP

(57) ABSTRACT

A high-heat-retention ladle for carrying molten aluminum includes a ladle body defining therein a storage space, which contains molten aluminum therein, the ladle body including a molten metal inlet and a molten metal outlet, which allow the storage space to communicate with outside, a cover opening and closing the inlet of the ladle body, and a stopper opening and closing the outlet of the ladle body. Each of the ladle body and the cover has an outer shell, which defines a contour thereof, and a multi-layer insulation structure inside the outer shell. The multi-layer insulation structure includes two or more refractory layers. The molten aluminum contained inside the storage space has a temperature drop rate of 5° C./min or less. It is possible to carry the molten aluminum for a long time in a heat-insulated state and cast a product by directly pouring the molten aluminum into a mold.

4 Claims, 8 Drawing Sheets

HIGH-HEAT-RETENTION LADLE FOR CARRYING MOLTEN ALUMINUM

CROSS REFERENCE TO RELATED APPLICATION

The present application claims priority from Korean Patent Application Number 10-2009-0046335 filed on May 27, 2009, the entire contents of which application is incorporated herein for all purposes by this reference.

BACKGROUND OF THE INVENTION

1. Field of the Invention

The present invention relates to a high-heat-retention ladle for carrying molten aluminum, and more particularly, to a high-heat-retention ladle that can carry molten aluminum for a long time in a heat-insulated state in order to cast a product by directly pouring the molten aluminum into a mold without having to convert raw materials into an ingot and then melt the ingot again.

2. Description of Related Art

Aluminum is used as a component material for a variety of machines such as vehicles and aircraft. Aluminum is generally used in the form of alloys combined with other light metals in order to increase its strength, and aluminum alloys can reduce the weight of products by 50% or more compared to typical steel materials. Therefore, the use of aluminum materials is continuously increasing due to their advantageous effects. For example, aluminum materials can improve performance by decreasing the weight of structures, and can especially reduce the use of energy and the output of pollutants in consideration of high oil prices and environmental problems, which are becoming more important these days.

A considerable portion (about 40%) of aluminum (alloy) products is produced by a casting method in which raw materials are melted by loading them into a smelter, and then molten metal is formed into a particular shape by pouring it into a mold. The casting method is widely used in the manufacture of components of machines since it has excellent advantages in terms of productivity and size consistency.

A conventional process of producing products by aluminum casting such as die casting includes first processing of making an aluminum ingot by melting raw materials and second processing of casting final products by melting the aluminum ingot again.

That is, an aluminum ingot is prepared as an intermediate product by melting an aluminum raw material, which is refined or reproduced in a raw material alloying plant, alloying metals, and the like and pouring molten metal into a mold. Afterwards, a product casting plant produces a final product by again melting the aluminum ingot, which is supplied thereto, and performing a casting process, such as die casting.

As described above, in the conventional art, aluminum is carried in the form of an ingot to the casting plant even though it is melted in the raw material alloying plant. Therefore, the casting process of making the aluminum ingot in the alloying plant incurs high manpower and facilities costs, and the cycle of supplying aluminum is prolonged, thereby decreasing cost efficiency and productivity.

The product casting plant also incurs a great amount of time and expense in the process of melting the aluminum ingot again, thereby decreasing cost efficiency and productivity. In addition, a considerable amount of materials is additionally lost due to the oxidation of aluminum during melting. Furthermore, this causes problems of a deteriorated working environment and air pollution in the surroundings since a great amount of dust and pollutants, such as SOx or NOx, is produced.

The information disclosed in this Background of the Invention section is only for the enhancement of understanding of the background of the invention, and should not be taken as an acknowledgment or any form of suggestion that this information forms a prior art that would already be known to a person skilled in the art.

BRIEF SUMMARY OF THE INVENTION

Various aspects of the present invention provide a high-heat-retention ladle that can carry molten aluminum for a long time in a heat-insulated state in order to cast a product by directly pouring the molten aluminum into a mold without having to convert raw materials into an ingot and then melt the ingot again.

In an aspect of the present invention, the high-heat-retention ladle for carrying molten aluminum may include a ladle body defining therein a storage space, which contains molten aluminum therein, the ladle body including a molten metal inlet and a molten metal outlet, which allow the storage space to communicate with outside; a cover opening and closing the inlet of the ladle body; and a stopper opening and closing the outlet of the ladle body. Each of the ladle body and the cover has an outer shell, which defines a contour thereof, and a multi-layer insulation structure inside the outer shell. The multi-layer insulation structure includes two or more refractory layers. The molten aluminum contained inside the storage space has a temperature drop rate of 5° C./min or less.

According to an exemplary embodiment of the present invention, the multi-layer insulation structure of the ladle body can include an outer molded refractory, an outer castable refractory, an inner molded refractory, and an inner castable refractory, which are stacked sequentially over the inner surface of the outer shell toward the inside of the ladle body. The inner castable refractory can be made of a material chemically unreactive with aluminum, and the inner molded refractory can be made of a silicon dioxide based molded material that alleviates weight and impact between the inner castable refractory and the outer castable refractory.

According to an exemplary embodiment of the present invention, the inner castable refractory can include an inside wall protruding upward from the bottom central portion of the ladle body.

Alternatively, the multi-layer insulation structure of the ladle body can have a castable refractory structure provided innermost of the ladle body, the castable refractory structure being unreactive with the molten aluminum. The castable refractory structure can includes an HD board type castable refractory provided on the side wall of the ladle body; a castable refractory provided on the side wall in the outlet side, the castable refractory including silicon dioxide ($SiO_2$), aluminum oxide ($Al_2O_3$), and calcium oxide (CaO); and a castable refractory provided on the bottom of the ladle body, the castable refractory made of silicon nitride ($Si_3N_4$) coupled silicon carbide (SiC).

Here, the castable refractory structure can also include an outer molded refractory in contact with the inner surface of the outer shell of the ladle body. The outer molded refractory can be a microporous insulator, which includes silicon dioxide ($SiO_2$) and silicon carbide (SiC).

In addition, the castable refractory structure can also include an inner molded refractory interposed between the castable refractories and the outer molded refractory. The inner molded refractory can be ceramic pelts to which inorganic binder is impregnated.

According to exemplary embodiments of the present invention as set forth above, the following effects are realized.

(1) Since the insulator having a multi-layer structure, in which the outer molded refractory, the outer castable refractory, the inner molded refractory, and the inner castable refractory are stacked sequentially, is provided inside the outer shell to prevent the heat of molten aluminum from escaping to the outside, it is not necessary to produce an ingot in a raw material supplying plant to carry aluminum or melt the ingot again in a product casting plant. Accordingly, it is possible to reduce manpower and costs, improve productivity, reduce materials costs, and reduce the output of pollutants.

(2) Since suitable types of refractory layers, each of which has a suitable thickness, are provided to satisfy a variety of insulating conditions according to the respective portions of the ladle body, it is possible to reduce the weight of the ladle and thus improve delivery performance.

The methods and apparatuses of the present invention have other features and advantages which will be apparent from, or are set forth in greater detail in the accompanying drawings, which are incorporated herein, and in the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments that may be included within the spirit and scope of the invention as defined by the appended claims.

Figure 1:
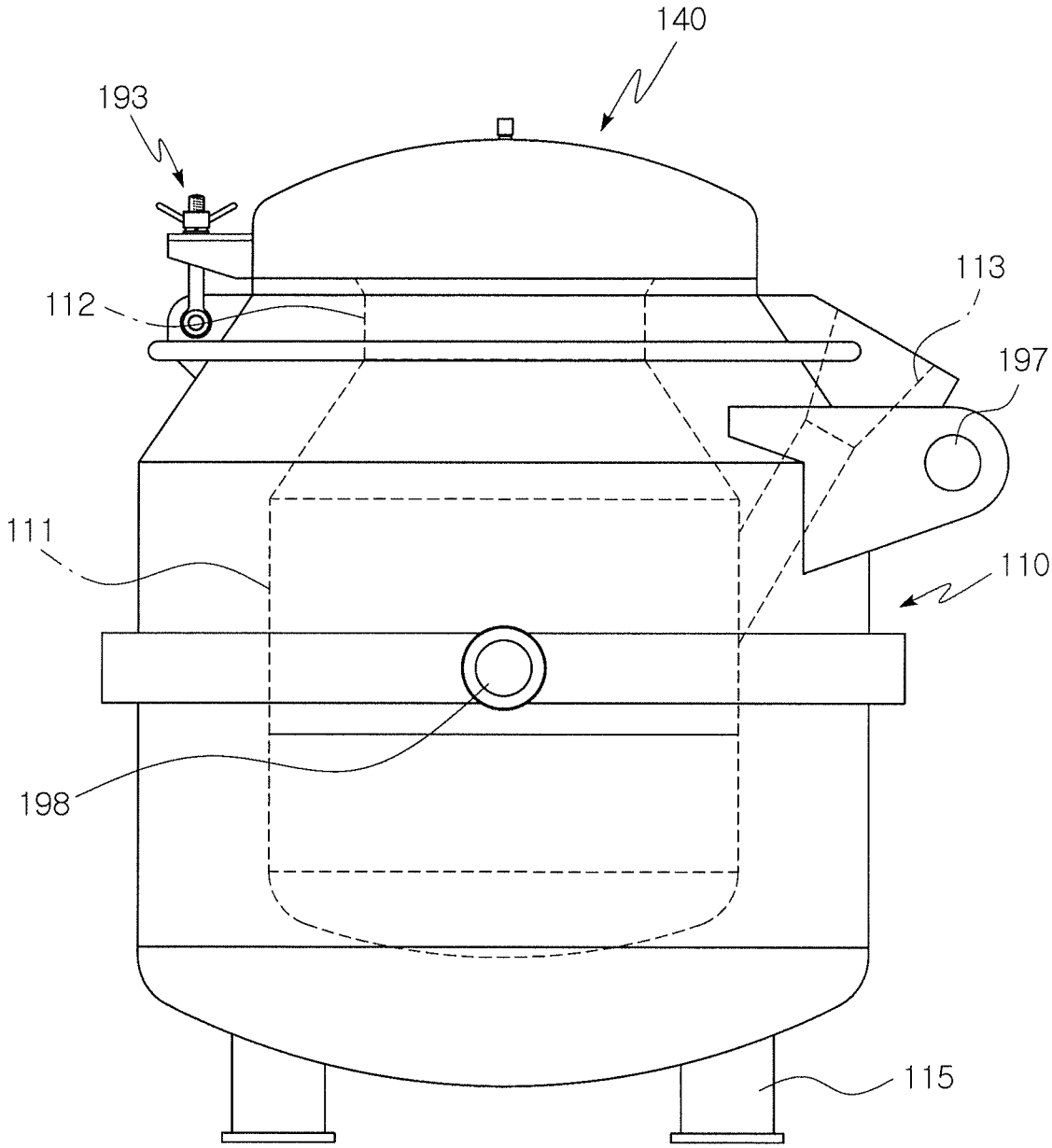
FIG. 1 is an elevational view showing the outline of a high-heat-retention ladle for carrying molten aluminum according to an exemplary embodiment of the invention.
Figure 2:
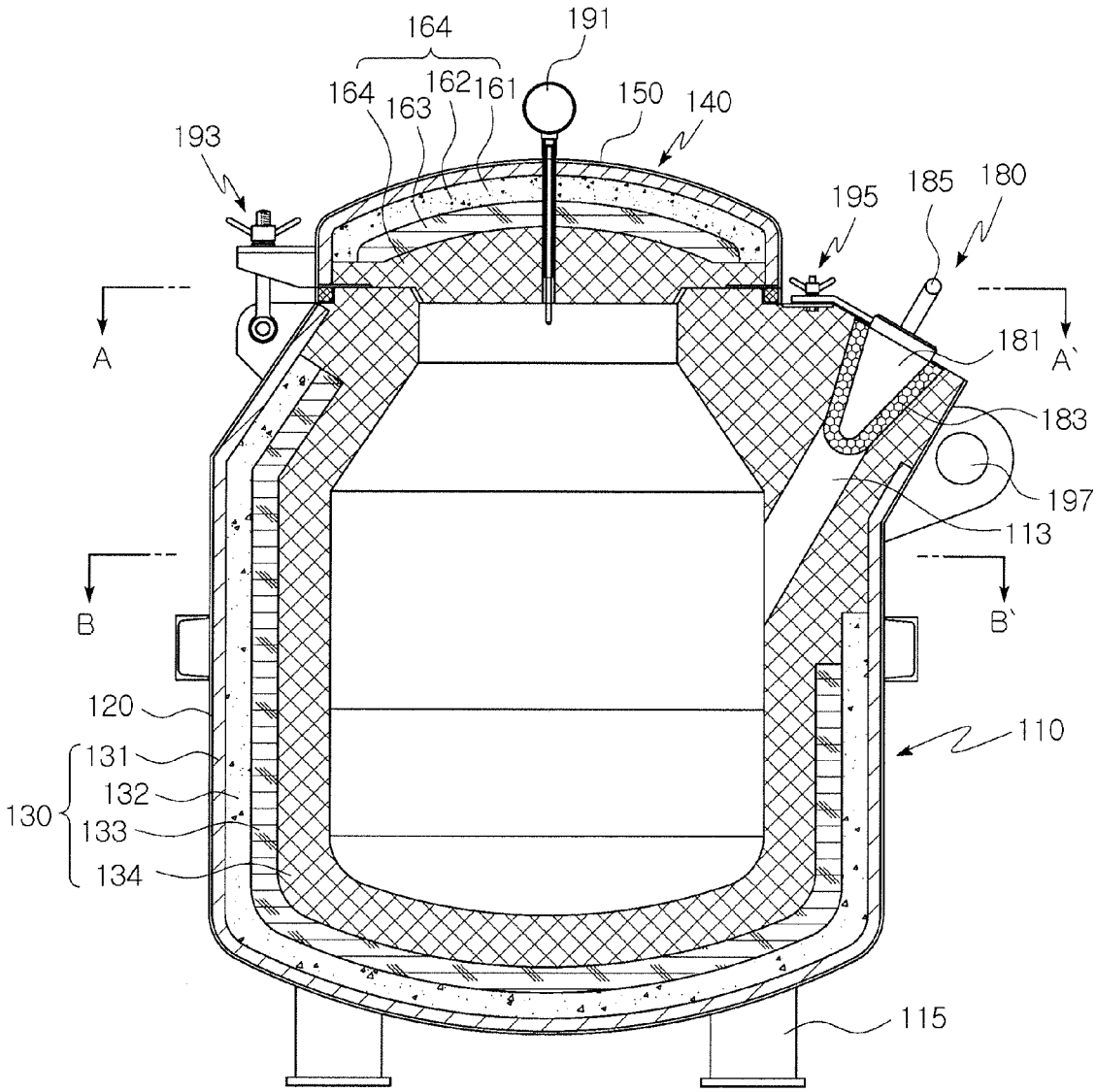
FIG. 2 is a front elevational cross-sectional view showing the ladle shown in FIG. 1.
Figure 3:
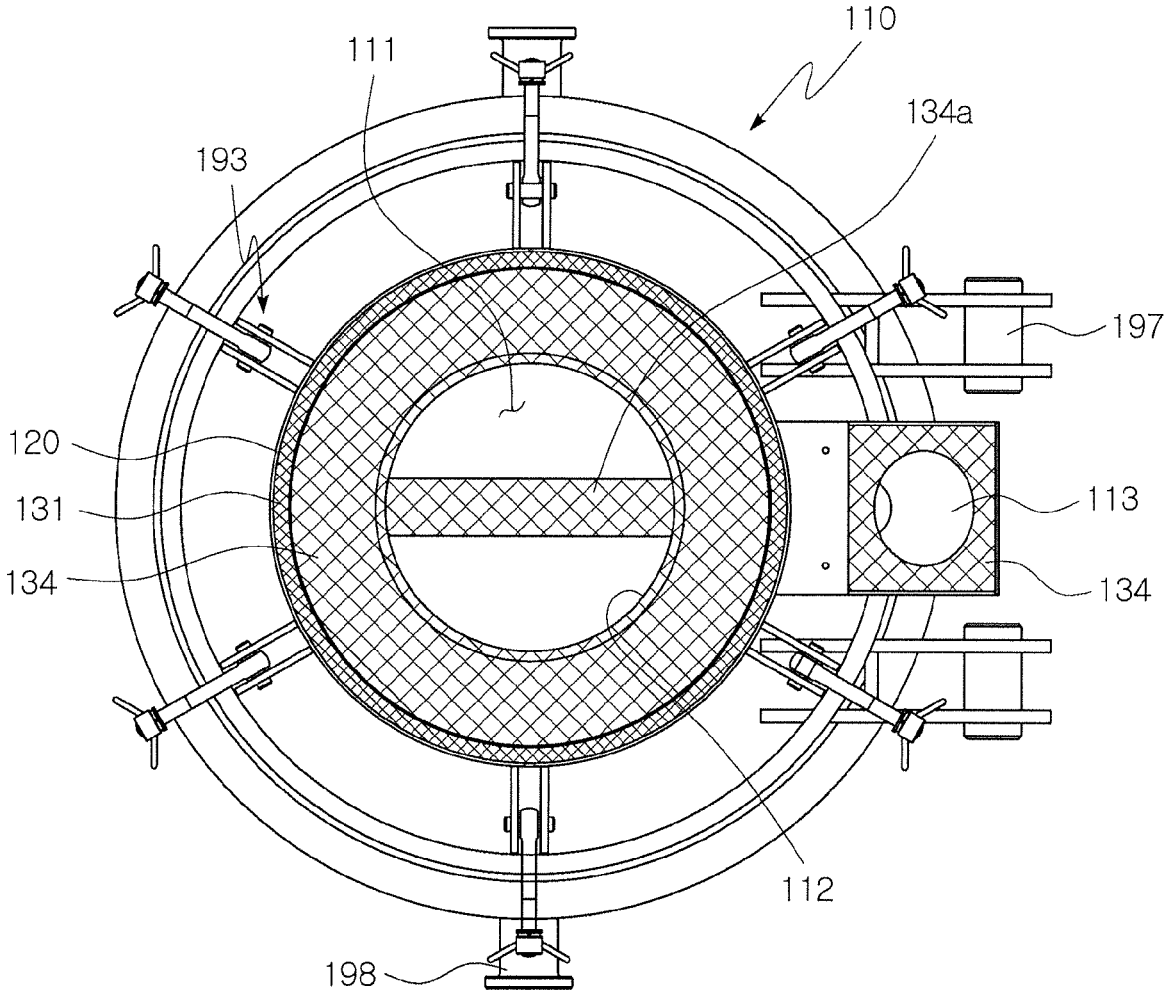
FIG. 3 is a top plan cross-sectional view taken along the line A-A' in FIG. 2.
Figure 4:
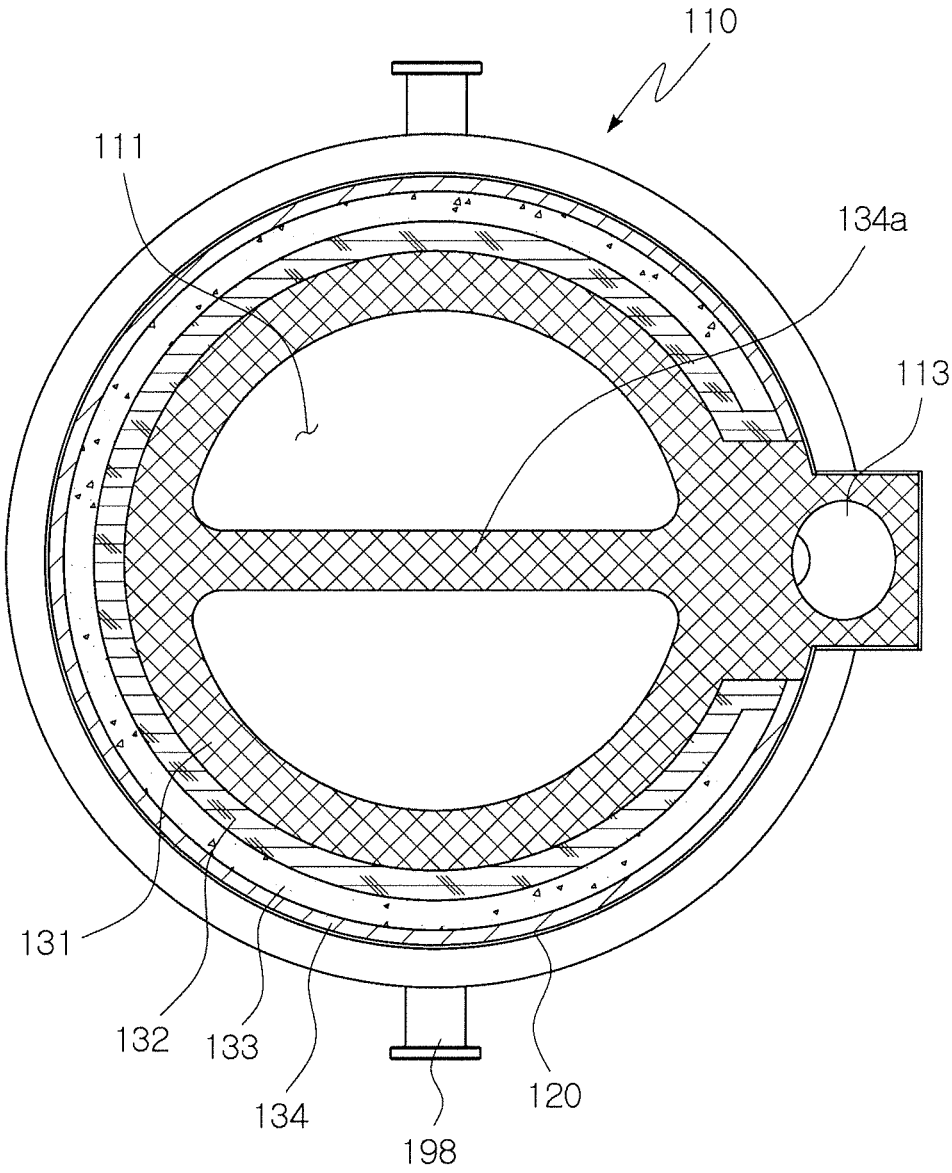
FIG. 4 is a top plan cross-sectional view taken along the line B-B' in FIG. 2.
Figure 5:
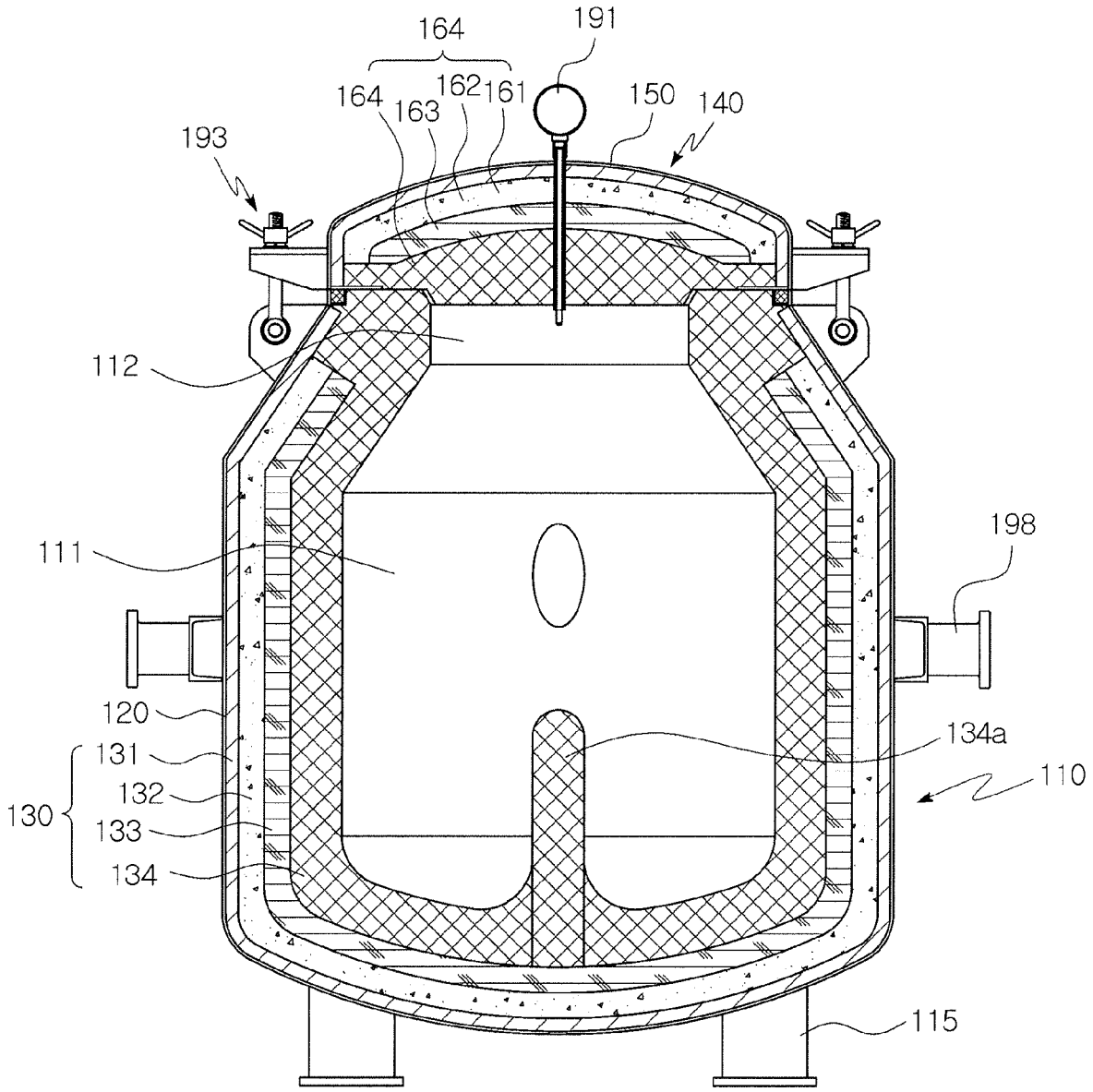
FIG. 5 is a side elevational cross-sectional view showing the ladle shown in FIG. 1.

FIG. 1 is an elevational view showing the outline of a high-heat-retention ladle for carrying molten aluminum according to an exemplary embodiment of the invention, FIG. 2 is a front elevational cross-sectional view showing the ladle shown in FIG. 1, FIG. 3 is a top plan cross-sectional view taken along the line A-A' in FIG. 2, FIG. 4 is a top plan cross-sectional view taken along the line B-B' in FIG. 2, and FIG. 5 is a side elevational cross-sectional view showing the ladle shown in FIG. 1.

As shown in FIGS. 1 to 5, the high-heat-retention ladle includes a ladle body 110, a cover 140, and a stopper 180. The ladle body 110 defines therein a storage space 111, which contains molten aluminum therein, and has a molten metal inlet 112 and a molten metal outlet 113 in upper and side portions thereof, which communicate with the storage space 111. The cover 140 is coupled to the upper portion of the ladle body 110 to open and close the inlet 112, and the stopper 180 is coupled to the outer end of the outlet 113 of the ladle body 110 to open and close the outlet 113.

The ladle body 110 has an outer shell 120, which forms the outside wall thereof, and an insulator 130 having a multi-layer structure inside the outer shell 120.

The outer shell 120 is made of a metal material, preferably steel, which has sufficient strength and rigidity such that it can maintain its structural shape against the weight and pressure of molten aluminum contained inside the ladle, external impacts, and the like while preventing the insulator 130 from being damaged.

The insulator 130 has a multi-layer structure in which an outer molded refractory material 131 is attached to the inside wall surface of the outer shell 120, and an outer castable refractory 132, an inner molded refractory 133, and an inner castable refractory are stacked sequentially inside the outer molded refractory 131.

The inner castable refractory 134 is a main refractory, which is provided to be innermost and is in direct contact with molten aluminum, contained inside the ladle body 110, in order to prevent the heat of the molten aluminum from escaping to the outside. The inner castable refractory 134 is made of a material that is not chemically reactive with aluminum and is sufficiently able to endure the weight of the molten aluminum contained therein.

In addition, the inner castable refractory 134 has an inside wall 134*a* protruding upward from the bottom central portion of the ladle body 110. The inside wall 134*a* prevents heat from being concentrated in the central portion of the ladle body 110 at an early stage of the input of molten aluminum and prevents contained molten aluminum from flowing, thereby delaying heat dissipation and preventing the weight from being biased to one portion inside the ladle body 110.

The inner molded refractory 133 serves as a refractory as well as a buffer that alleviates weight and impact transferred between the inner castable refractory 134 and the outer castable refractory 132. The inner molded refractory 133 is made of a silicon dioxide-based molded material, which has excellent heat-insulating characteristics.

The outer castable refractory 132 has heat insulation and durable properties, like the inner castable refractory 134, but is made of a cheaper material than the inner castable refractory 134 for the sake of economic efficiency.

The outer molded refractory 131 serves as a refractory as well as a buffer that alleviates weight and impact transferred between the outer castable refractory 132 and the outer shell 120. The outer molded refractory 131 is made of a silicon dioxide-based molded material. For example, the outer molded refractory 131 is preferably made of a molded fiberglass material.

Like the ladle body 110, the cover 140 has an outer shell 150 made of steel and a multi-layer structure arranged inside the outer shell 150. The multi-layer structure includes an outer molded refractory 161, an outer castable refractory 162, an inner molded refractory 163, and an inner castable refractory 164, which are stacked sequentially inside the outer shell 150.

The cover 140 has a thermometer mounted thereon, which indicates the temperature of the molten aluminum, and cover clamps 193, which fix the cover 140 in a closed state to the ladle body 110, are provided on the edge of the cover 140.

The stopper 180 is fitted into the outlet 113 of the ladle body 110 and is fixed in that state by a stopper clamp 195. The stopper 180 has a refractory 183 mounted on the portion thereof, which is fitted into the outlet 113, and a hook 185 provided on the externally exposed portion thereof. The hook 185 is used to draw out the stopper 180.

With the above-described structure, the high-heat-retention ladle according to an exemplary embodiment of the invention can maintain the temperature of the molten aluminum contained in the storage space of the ladle body 110, thereby making unnecessary the processes of making an aluminum ingot and melting the aluminum ingot again.

That is, with the multi-layer insulation structure, in which the outer molded refractory 131, 161, the outer castable refractory 132, 162, the inner molded refractory 133, 163, and the inner castable refractory 134, 164 are stacked sequentially inside the outer shell 120, 150, the ladle body 110 and the cover 140 can efficiently prevent the heat of the molten aluminum from escaping to the outside, thereby suppressing the temperature drop of the molten aluminum at about 1° C./min or less.

Therefore, assuming that the shipping temperature of the molten aluminum is approximately 750° C., it is possible to supply aluminum in a molten state, such that it can be directly cast into a product, to a remote casting plant that requires a delivery time of about 2 hours.

Therefore, an aluminum material supplier can advantageously reduce manpower and facilities costs and shorten the aluminum supply cycle, thereby improving cost efficiency and productivity, since the process of making an ingot for the purpose of delivery after having melted aluminum is not necessary.

In addition, since the product casting plant does not need the process of melting again the supplied aluminum ingot, it is possible to reduce product-manufacturing costs, improve productivity, and reduce materials costs and provide better working environment to workers by preventing the loss of aluminum due to oxidation during melting as well as the output of pollutants.

Meanwhile, the present invention is not limited to the certain exemplary embodiment as described above. In particular, the insulator mounted inside the ladle body 110 and the cover 140 can be variously selected.

Figure 6:
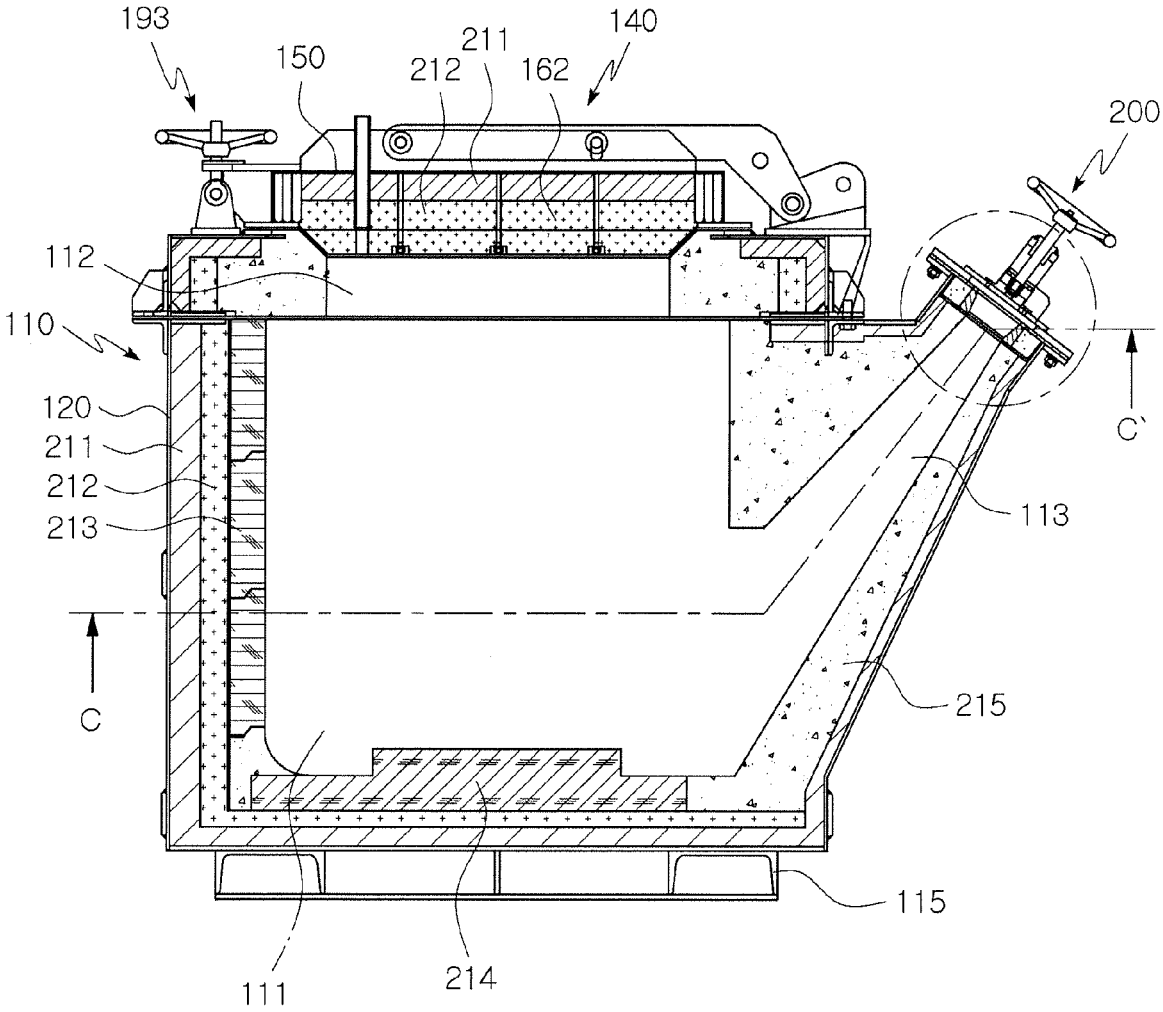
FIG. 6 is a front elevational cross-sectional view showing a high-heat-retention ladle for carrying molten aluminum according to another exemplary embodiment of the invention.
Figure 7:
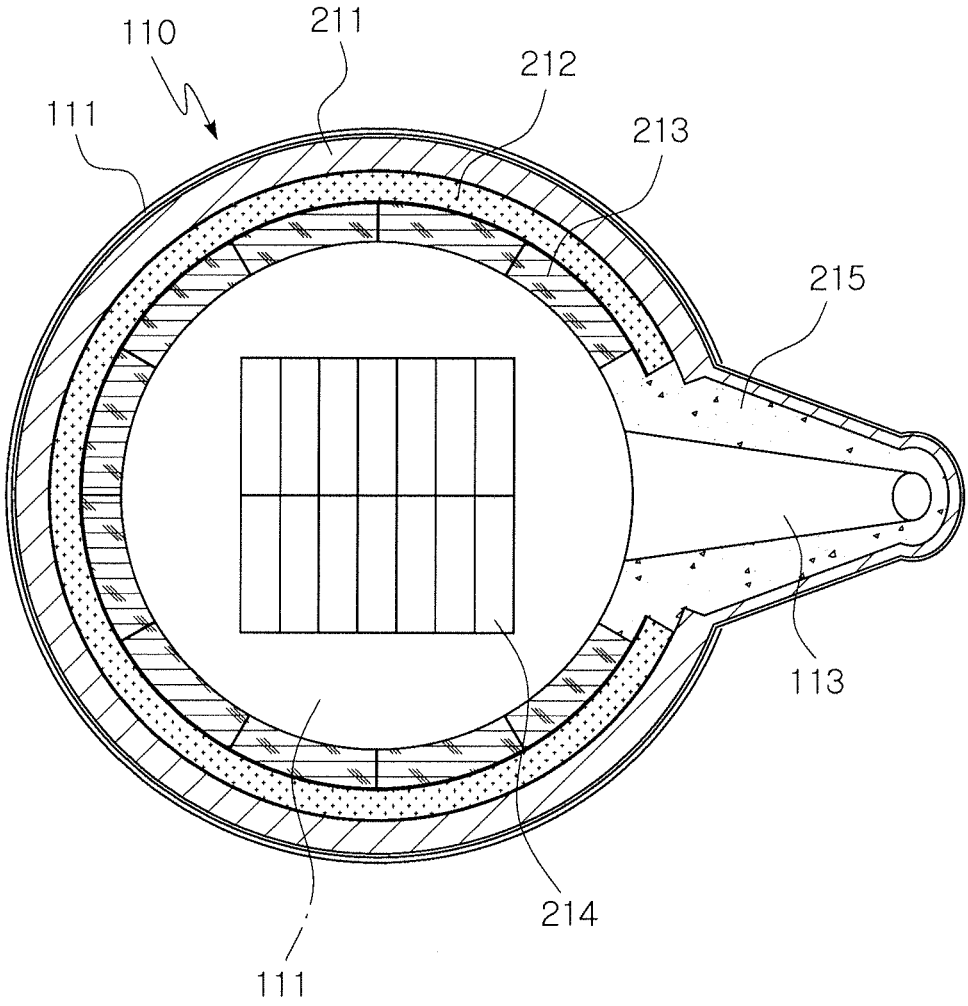
FIG. 7 is a top plan cross-sectional view of the ladle shown in FIG. 6.
Figure 8:
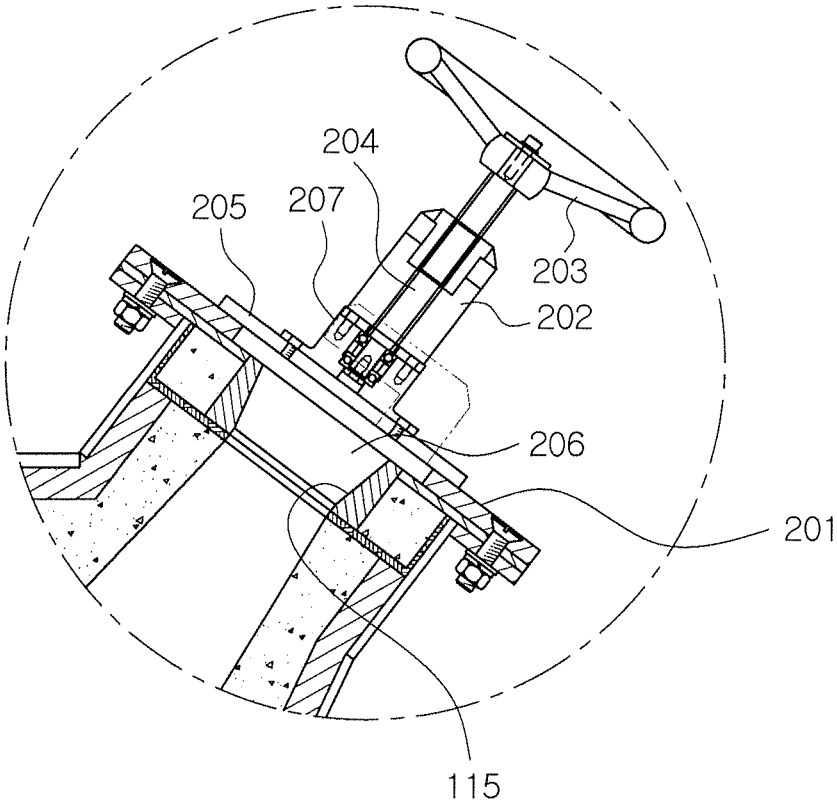
FIG. 8 is a detailed view of a stopper of the ladle shown in FIG. 6.

Another exemplary embodiment of the invention is shown in FIGS. 6 to 8.

FIG. 6 is a front elevational cross-sectional view showing a high-heat-retention ladle for carrying molten aluminum according to another exemplary embodiment of the invention, FIG. 7 is a top plan cross-sectional view of the ladle shown in FIG. 6, and FIG. 8 is a detailed view of a stopper of the ladle shown in FIG. 6.

Referring to FIGS. 6 to 8, in the ladle for carrying molten aluminum according to this exemplary embodiment of the invention, like the foregoing embodiment, the cover 140 is coupled to the upper portion of the ladle body 110, the stopper 180 is fitted into the outlet 113 of the ladle body 110, and the ladle body 110 and the cover 140 have a multi-layer insulation structure.

In this embodiment, a castable refractory structure, which is not reactive with molten aluminum, is provided in the innermost portion of the ladle body 110. The castable refractory structure can include different types of castable refractories depending on respective portions of the ladle body 110. That is, an HD board type castable refractory 213 is provided on the side wall of the ladle body 110, a castable refractory 215 (trade name VIOALC), which includes silicon dioxide ($SiO_2$) 31%, aluminum oxide ($Al_2O_3$) 35%, and calcium oxide (CaO) 33%, is provided on the side wall in the outlet side, and a castable refractory 214, which is made of silicon nitride ($Si_3N_4$) coupled silicon carbide (SiC), is provided on the bottom of the ladle body 110.

An outer molded refractory 211 is provided directly inside of the steel outer shell 120, which forms the contour of the ladle body 110. It is preferred that the outer molded refractory 211 be made of a microporous insulator (trade name WDS), which includes silicon dioxide ($SiO_2$) 80% and silicon carbide (SiC) 15%.

An inner molded refractory 212 is provided between the castable refractories 213, 214, and 215 and the outer molded refractory 211. The inner molded refractory 212 can be made of ceramic pelts to which inorganic binder is impregnated.

Likewise, the cover 140 is structured such that a molded refractory 211 and a castable refractory 212 are provided inside the outer shell 150.

The high-heat-retention ladle of this embodiment can reduce its weight and thus improve delivery performance, since suitable types of refractory layers, each of which has a suitable thickness, are provided to satisfy a variety of insulating conditions according to the respective portions of the ladle body.

The foregoing descriptions of specific exemplary embodiments of the present invention have been presented for the purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A high-heat-retention ladle for carrying molten aluminum, comprising:

a ladle body defining therein a storage space, which contains molten aluminum therein, wherein the ladle body includes a molten metal inlet and a molten metal outlet, which allow the storage space to communicate with outside;

a cover opening and closing the inlet of the ladle body; and a stopper opening and closing the outlet of the ladle body, wherein each of the ladle body and the cover has an outer shell, which defines a contour thereof, and a multi-layer insulation structure inside the outer shell, the multi-layer insulation structure including two or more refractory layers, whereby the molten aluminum contained inside the storage space has a temperature drop rate of 5° C/min or less, wherein the multi-layer insulation structure of the ladle body includes an outer molded refractory, an outer castable refractory, an inner molded refractory, and an inner castable refractory, which are stacked sequentially over an inner surface of the outer shell toward inside of the ladle body, wherein the inner castable refractory is made of a material chemically unreactive with aluminum, and the inner molded refractory is made of a silicon dioxide based molded material that alleviates weight and impact between the inner castable refractor and the outer castable refractory, and wherein the inner castable refractory includes an inside wall protruding upward from a bottom central portion of the ladle body.

2. The high-heat-retention ladle according to claim 1, wherein the multi-layer insulation structure of the ladle body comprises a castable refractory structure provided innermost of the ladle body, the castable refractory structure being unreactive with the molten aluminum, wherein the castable refractory structure includes:

an HD board type castable refractory provided on a side wall of the ladle body;

a castable refractory provided on a side wall in the outlet side, the castable refractory including silicon dioxide ($SiO_2$), aluminum oxide ($Al_2O_3$), and calcium oxide (CaO); and a castable refractory provided on a bottom of the ladle body, the castable refractory made of silicon nitride ($Si_3N_4$) coupled silicon carbide (SiC).

3. The high-heat-retention ladle according to claim 2, wherein the castable refractory structure further includes an outer molded refractory in contact with an inner surface of the outer shell of the ladle body, wherein the outer molded refractory comprises a microporous insulator, which includes silicon dioxide ($SiO_2$) and silicon carbide (SiC).

4. The high-heat-retention ladle according to claim 3, wherein the castable refractory structure further includes an inner molded refractory interposed between the castable refractories and the outer molded refractory, wherein the inner molded refractory comprises ceramic pelts to which inorganic binder is impregnated.

* * * * *

UNITED STATES PATENT AND TRADEMARK OFFICE

CERTIFICATE OF CORRECTION

PATENT NO. : 8,430,281 B2
APPLICATION NO. : 12/788000
DATED : April 30, 2013
INVENTOR(S) : Eok Soo Kim et al.

It is certified that error appears in the above-identified patent and that said Letters Patent is hereby corrected as shown below:

In the Claims

| | |
|---|---|
| Column 7, Claim 1, line 8 | Delete "refractor"<br>Insert -- refractory -- |

Signed and Sealed this
Twenty-fifth Day of February, 2014

Michelle K. Lee

Michelle K. Lee
*Deputy Director of the United States Patent and Trademark Office*